US012195150B2

(12) United States Patent
Fountain

(10) Patent No.: US 12,195,150 B2
(45) Date of Patent: Jan. 14, 2025

(54) BUOYANCY ADJUSTABLE SWIM TRAINING VEST

(71) Applicant: Steven Blair Fountain, Alexandria, VA (US)

(72) Inventor: Steven Blair Fountain, Alexandria, VA (US)

( * ) Notice: Subject to any disclaimer, the term of this patent is extended or adjusted under 35 U.S.C. 154(b) by 445 days.

(21) Appl. No.: 17/535,604

(22) Filed: Nov. 25, 2021

(65) Prior Publication Data

US 2022/0177090 A1 Jun. 9, 2022

Related U.S. Application Data

(60) Provisional application No. 63/214,203, filed on Jun. 23, 2021, provisional application No. 63/123,446, filed on Dec. 9, 2020.

(51) Int. Cl.
*B63C 9/115* (2006.01)
*A63B 69/12* (2006.01)

(52) U.S. Cl.
CPC ..... *B63C 9/115* (2013.01); *A63B 69/12* (2013.01); *A63B 2225/605* (2013.01)

(58) Field of Classification Search
CPC .... B63C 9/115; A63B 69/12; A63B 2225/605
See application file for complete search history.

(56) References Cited

U.S. PATENT DOCUMENTS 7,201,626 B1 * 4/2007 Nelson ..... B63C 9/115 441/106
10,457,363 B1 * 10/2019 Olds ..... B63C 9/08
2015/0126086 A1 * 5/2015 Gadler ..... A41D 13/0125 441/115

* cited by examiner

*Primary Examiner* — Stephen P Avila
(74) *Attorney, Agent, or Firm* — Ross Brandborg

(57) ABSTRACT

A buoyancy-adjustable swim training vest for a user has a polymer-neoprene fabric formed garment member designed to substantially circumscribe the user's torso from neck to waist. A lower front of the vest has a front cover coupled to the vest and is vertically liftable. A back portion has a right side and a left side elastic wing members extending from a lower back portion designed to wrap frontward around the user's torso and detachably couple by respective hook and loop assemblies to each other, the vest, and the front cover, all coupled beneath the cover. An at least one polymer strap may be coupled detachably and adjustably by a latch to a buckle disposed on a lower edge of the front of the vest. At least one substantially sealable back pocket is disposed on an outer surface of the lower back portion of the vest designed to hold removable buoyant pads.

9 Claims, 15 Drawing Sheets

BUOYANCY ADJUSTABLE SWIM TRAINING VEST

CLAIM OF PRIORITY

This application claims the benefit of and priority to U.S. provisional application No. 63/123,446 filed on Dec. 9, 2020, titled BUOYANCY-ADJUSTABLE SWIM TRAINING VEST, and U.S. provisional application No. 63/214,203 filed on Jun. 23, 2021, titled BUOYANCY-ADJUSTABLE SWIM TRAINING VEST, the contents of which is incorporated by reference in their entireties.

FIELD OF THE INVENTION

The inventive concept relates generally to a buoyancy-adjustable swim training vest.

BACKGROUND

Currently, there are a number of solutions for swim training flotation aids. One of these solutions is inflatable water wings worn around children's arms, but this solution fails to meet the needs of the market because water wings obstruct the movement of the arms when the child attempts to swim. Another solution attempts to utilize a traditional life vest, but this solution is similarly unable to meet the needs of the market because a traditional life vest is too buoyant and may limit the movement of the arms and the head. Still another solution is to rely on a trainer to monitor the children, but this solution may fail if the monitor is not suitably prepared. Therefore, there currently exists a need in the market for an improved buoyant vest for training children to swim.

SUMMARY

A buoyancy-adjustable swim training vest for a user has a sleeveless (optional, in a related embodiment sleeves are included) garment member designed to substantially circumscribe the user's torso from substantially the neck to the waist, the sleeveless garment member further comprising substantially a neoprene fabric (or polymer-neoprene fabric blend, but not limited to such). A front portion of the sleeveless garment member has, at a lower front portion of the sleeveless garment member, a front cover member that is removably coupled to an outer surface of the lower front portion of the sleeveless garment member by a first hook and loop assembly disposed on an interior face of the front cover member and disposed on the outer surface of the lower front portion of the sleeveless garment member, the front cover member pivotally and horizontally coupled to a middle front portion of the sleeveless garment member so as to be vertically liftable to expose the outer face of the lower front portion of the sleeveless garment member thereunder.

A back portion of the sleeveless garment member coupled to the front portion of the sleeveless garment member by a right shoulder portion and a left shoulder portion has a right side elastic wing member and a left side elastic wing member, the wing members horizontally aligned and extending from a lower back portion of the sleeveless garment member, a second hook and loop assembly disposed on front and back surfaces of the wing members, the wing members designed to wrap frontward around the user's torso and detachably couple by respective hook and loop assemblies to each other, to the outer surface of the lower front portion of the sleeveless garment member, and to the interior face of the front cover member of the lower front portion of the sleeveless garment member, the outer ends of the wing members overlapping each other and disposed between the interior surface of the front cover member and the outer face of the lower front portion of the sleeveless garment member.

Some embodiments of the inventive concept lack the front cover member and are secured around the user's torso with the wing members exposed.

One of ordinary skill in the art would recognize that other attachment methods could be used such as buckle, clip, and strap assemblies, ties, buckle and belt assemblies, flexible strips of metal or plastic with interlocking projections closed or opened by pulling a slide along them (zippers), or the buoyancy-adjustable swim training vest may be pulled over the wearer's head as would be a pullover shirt, may have elastic bands to make pulling over easier and to retain a tighter grasp around the body, and, therefore, may operate without attachment assemblies. Combinations of attachment assemblies may be used such as a hook and loop assembly supplemented by a buckle, clip, and strap assembly. Portions of the buoyancy-adjustable swim training vest may be made from materials other than neoprene to accommodate wearing and attachment methods. A fabric covering material for the neoprene may also be a part of the structural design.

An at least one polymer strap member may be coupled at a distal portion of the at least one strap member to the lower back portion of the sleeveless garment member at a horizontally centered position of the sleeveless garment member, the at least one strap member designed to detachably and adjustably couple by a latch portion coupled to a proximal end of the at least one strap member to an at least one buckle member, the at least one buckle member coupled to a lower edge portion of the front portion of the sleeveless garment member, the at least one strap member, when in a coupled state, designed to circumscribe the user's crotch. An at least one substantially sealable back pocket member is disposed on an outer surface of the lower back portion of the sleeveless garment member designed to hold at least one removable back buoyant pad member. The sealable back pocket member may, when in use or stored, hold no buoyant pad members. In this example instance, the vest itself may have buoyancy inherent in the neoprene.

A buoyant pad member is an insert that may be made from neoprene, a polymer foam, a polystyrene, an air bladder or bubble assembly, or other buoyant material. In one embodiment, the buoyant pad member is a polymer foam substantially one quarter inch thick. The addition or removal of buoyant pad members allows the buoyancy of the buoyancy-adjustable swimming training vest to be adjustable. The associated process is to remove buoyancy pads as a given child improves swimming skills and gains confidence in those skills.

In one embodiment of the buoyancy-adjustable swim training vest, at least one front pocket member is disposed on an outer surface of the front portion of the sleeveless garment member designed to hold at least one removable front buoyant pad member. In one embodiment, there are two front pocket members designed to hold up to three each buoyant pad members. The sealable back pocket member may, when in use or stored, hold no buoyant pad members.

In one embodiment of the buoyancy-adjustable swim training vest, a second pocket member is disposed substantially on the lower back portion of the sleeveless garment member designed to store the at least one strap member therein.

In one embodiment of the buoyancy-adjustable swim training vest for a user, there are three each removable back buoyant pad members designed to be disposed within the at least one back pocket member.

It would be advantageous to have a buoyancy-adjustable swim training vest that is adjustable for many sized people. Furthermore, it would also be advantageous to have a buoyancy-adjustable swim training vest that is substantially colored orange or yellow. Still further, it would be advantageous to have a buoyancy-adjustable swim training vest that allows free movement of arms and legs.

The inventive concept advantageously fills the aforementioned deficiencies by providing a buoyancy-adjustable swim training vest, which provides added flotation to help teach children to swim and to help keep children safe by adding buoyancy.

The buoyancy-adjustable swim training vest fulfills the need for added buoyancy to help teach children to swim. The inventive concept may be used for adults and may be made in several sizes.

Among other things, it is an advantage of the buoyancy-adjustable swim training vest to provide buoyancy for swim training that does not suffer from problems or deficiencies associated with prior solutions.

One of ordinary skill in the art would recognize that other fasters could be used beside hook and loop assemblies such as clips, buckles, ties, and zippers to fasten certain elements or to provide supplementary fasteners to the hook and loop assemblies.

Neoprene is a synthetic polymer resembling rubber, resistant to oil, heat, and weathering. It has buoyant properties by capturing microbubbles within fabric pores. Neoprene also offers insulating properties which may afford a further benefit for training children to swim if the water is colder than normal human body temperature.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Figure 1:
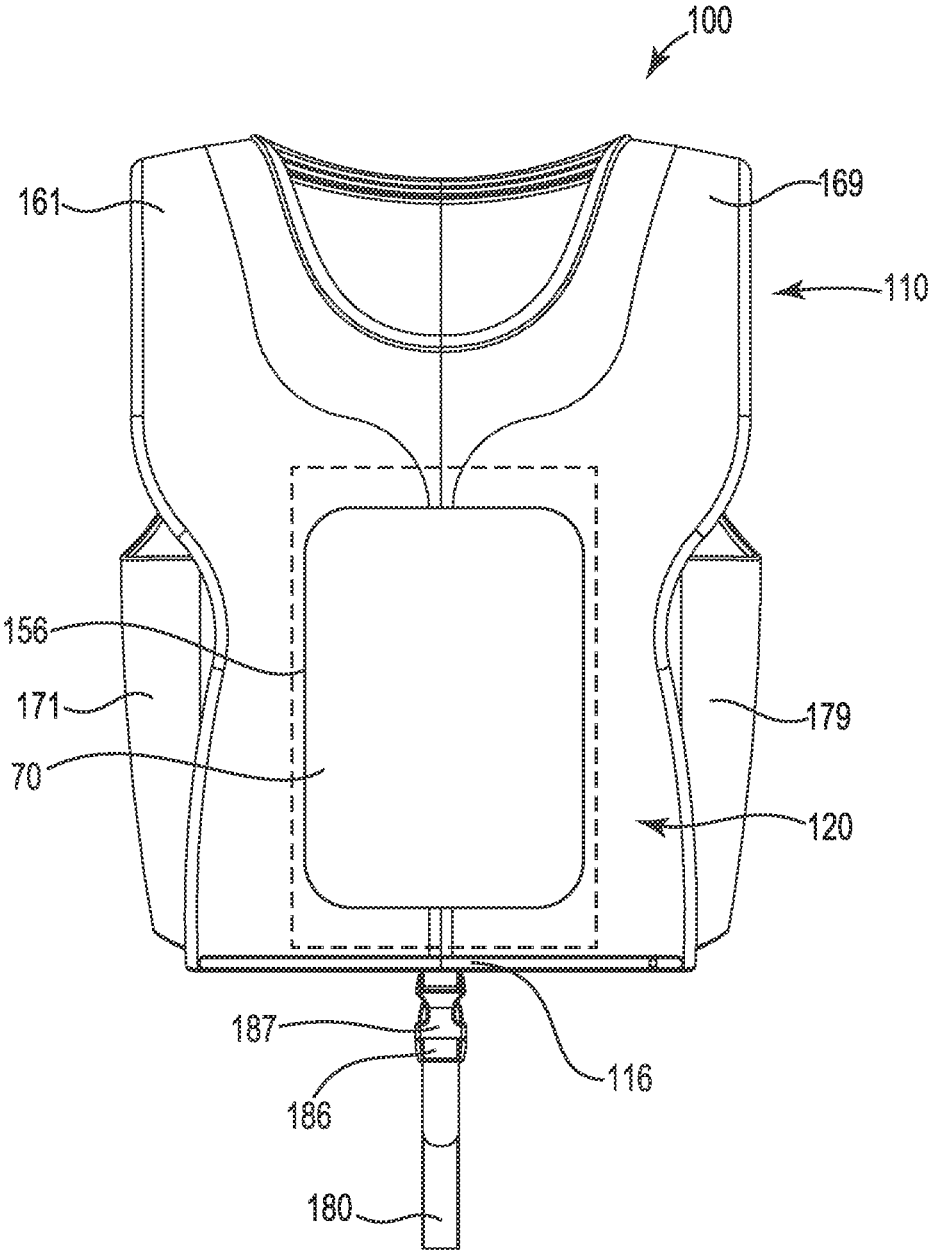
FIG. 1 illustrates the front view of the buoyancy-adjustable swim training vest.
Figure 2:
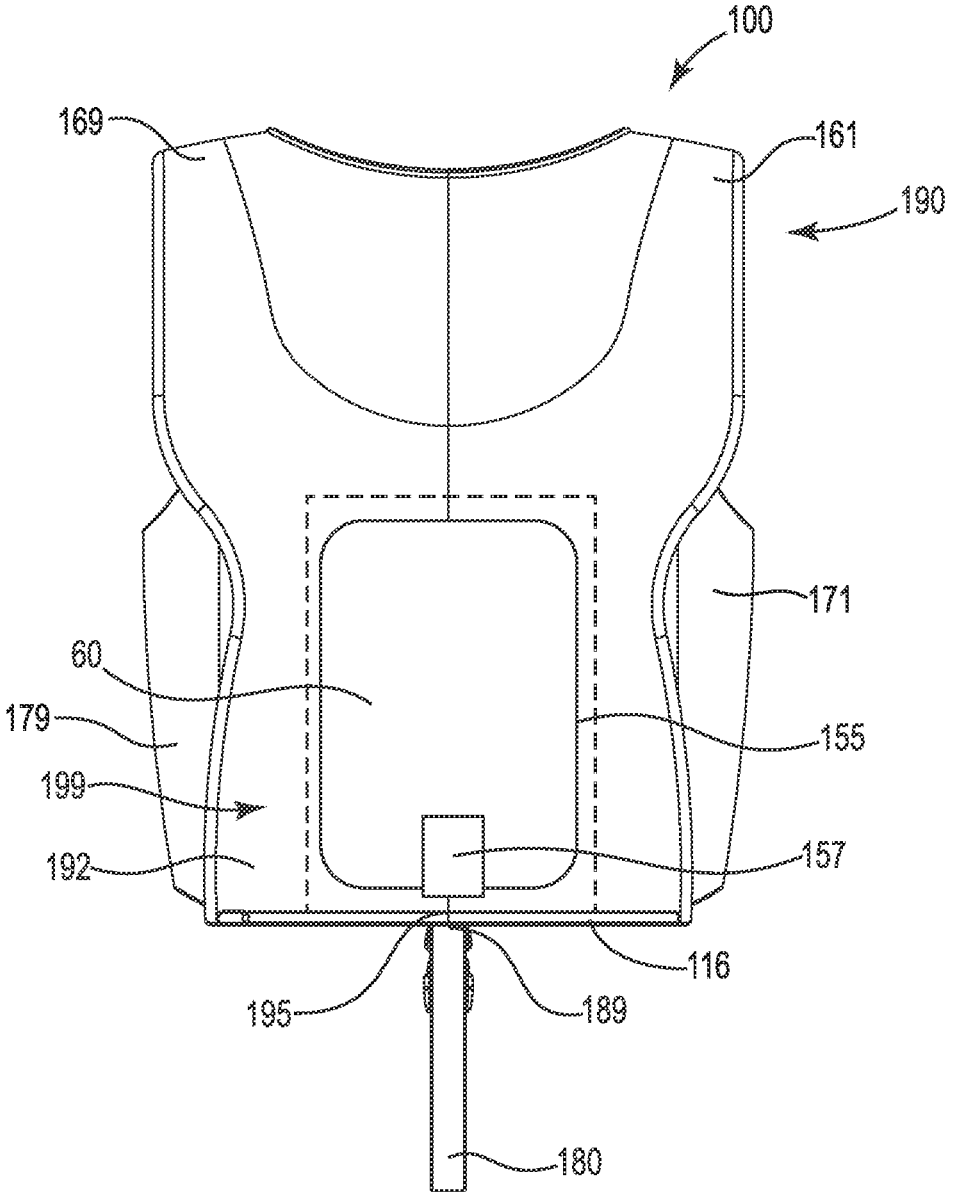
FIG. 2 illustrates the back view of the buoyancy-adjustable swim training vest.
Figure 3:
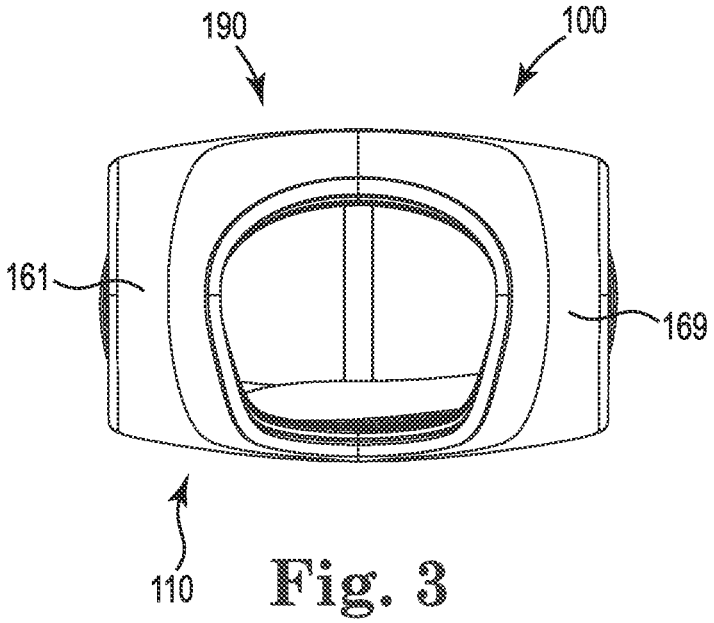
FIG. 3 illustrates the right side view of the buoyancy-adjustable swim training vest.
Figure 4:
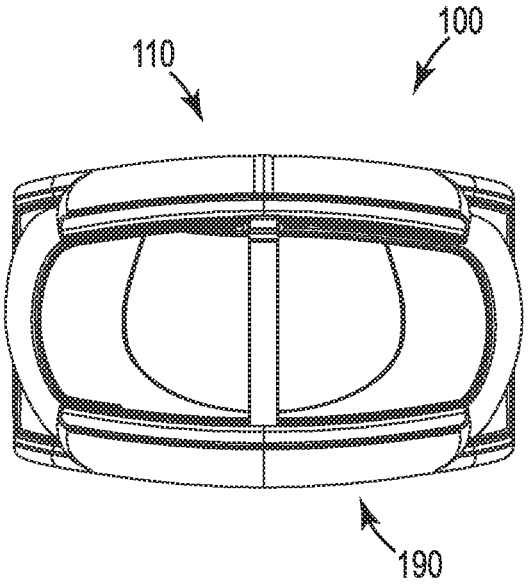
FIG. 4 illustrates the left side view of the buoyancy-adjustable swim training vest.
Figure 5:
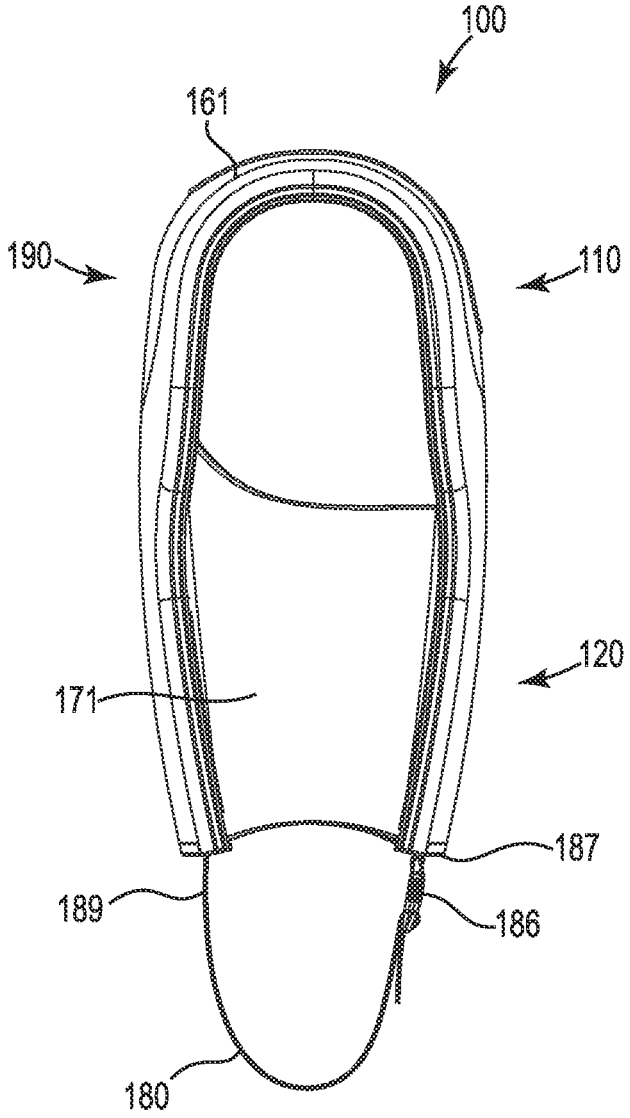
FIG. 5 illustrates the top view of the buoyancy-adjustable swim training vest.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Referring to the Figures, FIG. 1-9B illustrates one embodiment wherein a buoyancy-adjustable swim training vest for a user has a sleeveless garment member 100 designed to substantially circumscribe the user's torso from substantially the neck to the waist, the sleeveless garment member 100 further comprising substantially a neoprene fabric 50. A front portion of the sleeveless garment member 110 has, at a lower front portion of the sleeveless garment member 120, a front cover member 130 that is removably coupled to an outer surface of the lower front portion of the sleeveless garment member 120 by a first hook and loop assembly 141 disposed on an interior face of the front cover member 131 and disposed on the outer surface of the lower front portion of the sleeveless garment member 120, the front cover member 130 pivotally and horizontally coupled to a middle front portion of the sleeveless garment member 150 so as to be vertically liftable to expose the outer face of the lower front portion of the sleeveless garment member 120 thereunder.

Figure 6:
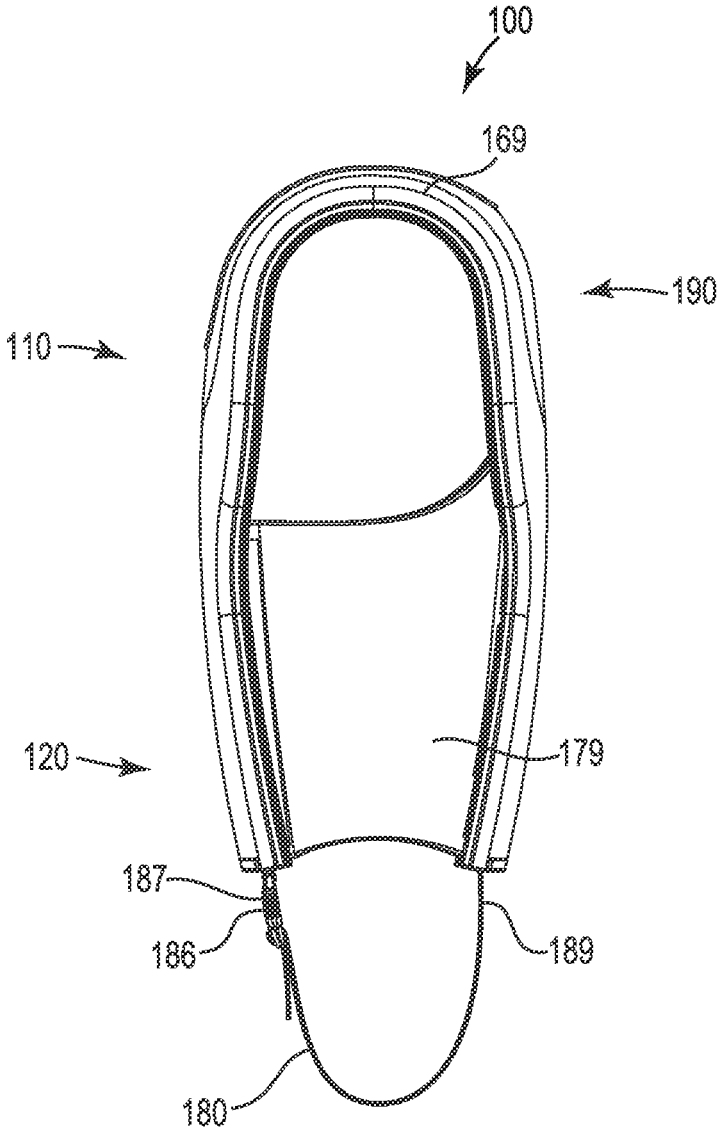
FIG. 6 illustrates the bottom view of the buoyancy-adjustable swim training vest.
Figure 7:
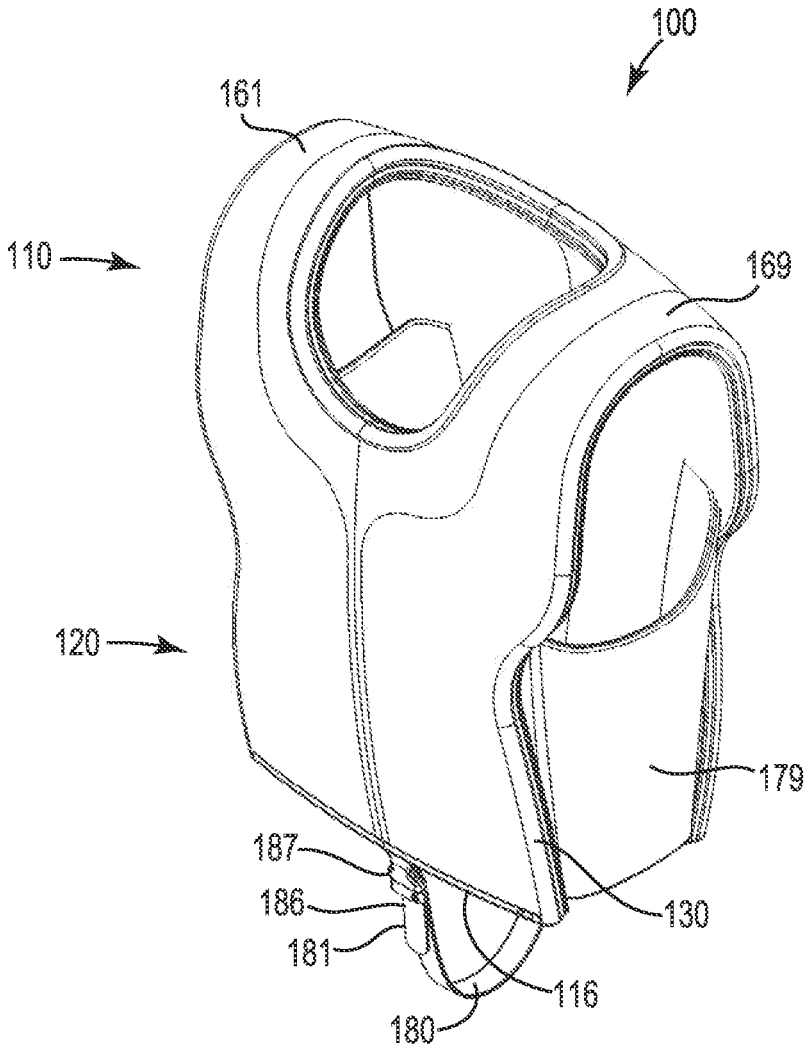
FIG. 7 illustrates the perspective view of the buoyancy-adjustable swim training vest.
Figure 10A:
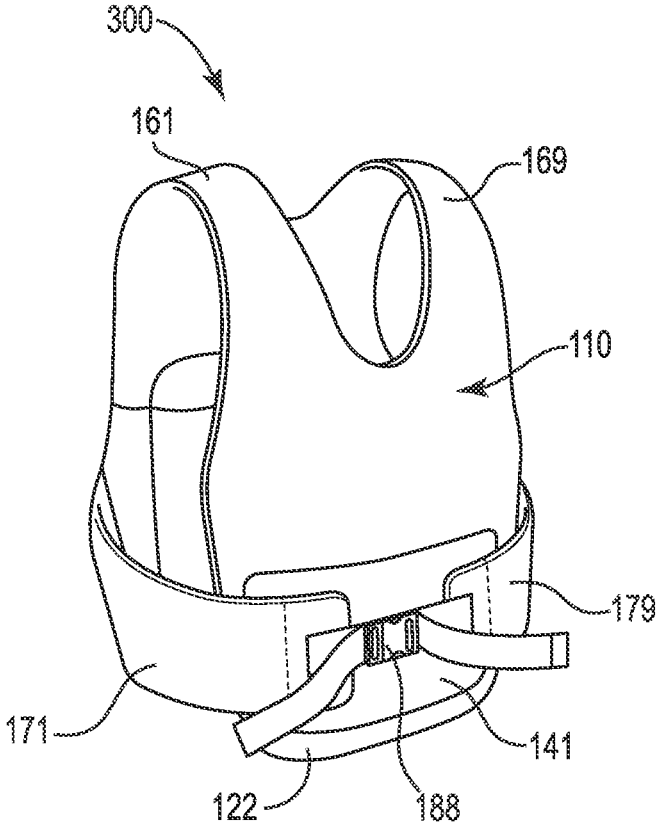
FIGS. 10A-10C illustrate perspective, internal and external views of another embodiment of the buoyancy-adjustable swim training vest.
Figure 10B:
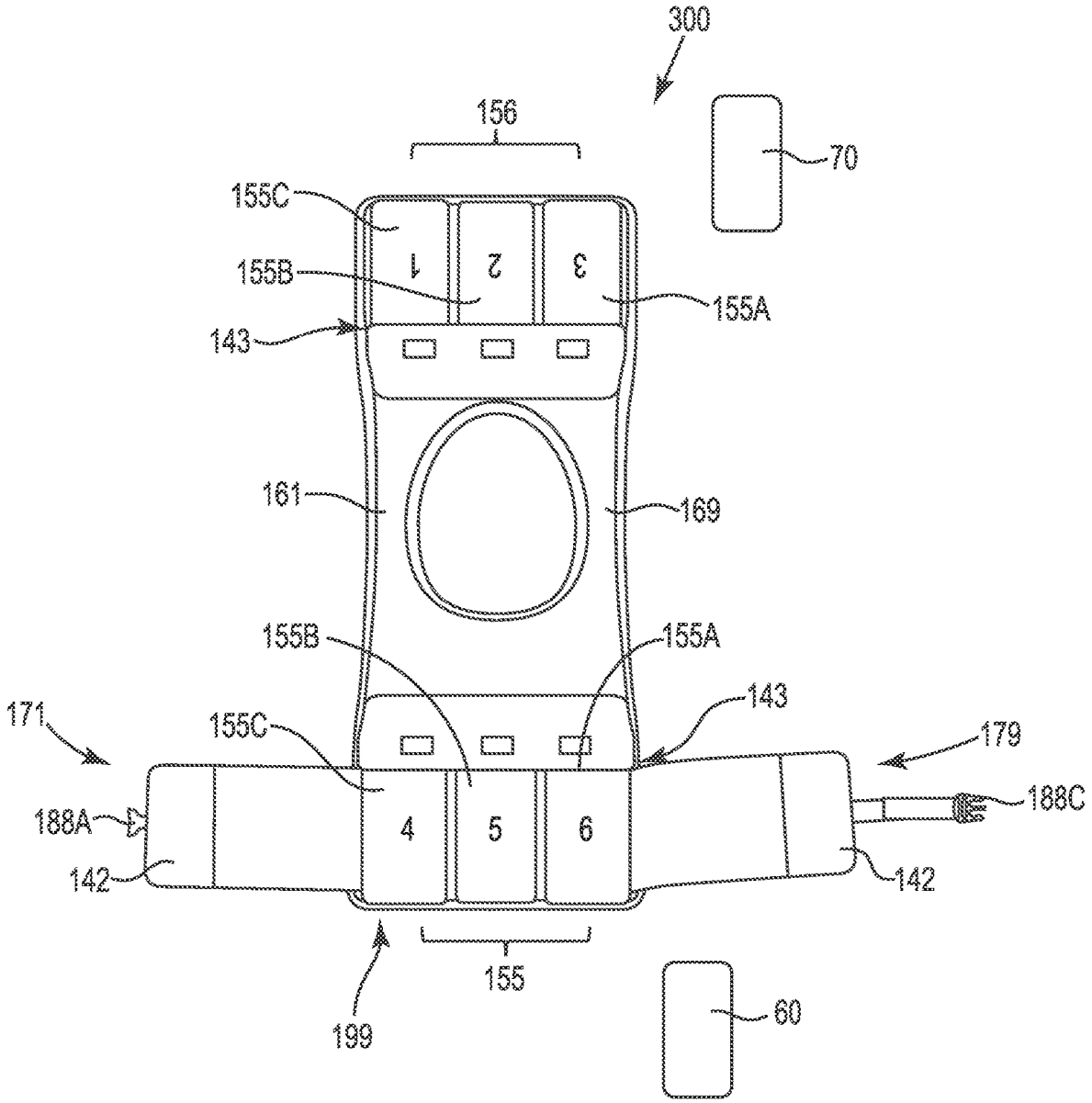

Referring briefly to FIGS. 6, 7 and 10B, a back portion of the sleeveless garment member 190 coupled to the front portion of the sleeveless garment member 110 by a right shoulder portion 161 and a left shoulder portion 169 has a right side elastic wing member 171 and a left side elastic wing member 179, the wing members 171, 179 horizontally aligned and extending from a lower back portion of the sleeveless garment member 199, a second hook and loop assembly 142 disposed on front surfaces 174 and back surfaces 176 of the wing members 171, 179, the wing members 171, 179 designed to wrap frontward around the user's torso and detachably couple by respective first and second hook and loop assemblies 141, 142 to each other, to the outer surface of the lower front portion of the sleeveless garment member 122, and to the interior face of the front cover member 131 of the lower front portion of the sleeveless garment member 120, the right outer end 172 and the left outer end 178 of the wing members 171, 179 overlapping each other and disposed between the interior face of the front cover member 131 and the outer surface of the lower front portion of the sleeveless garment member 120. An at least one substantially sealable back pocket member 155 is disposed on an outer surface of the lower back portion of the sleeveless garment member 199 designed to hold at least one removable back buoyant pad member 60.

Figure 8:
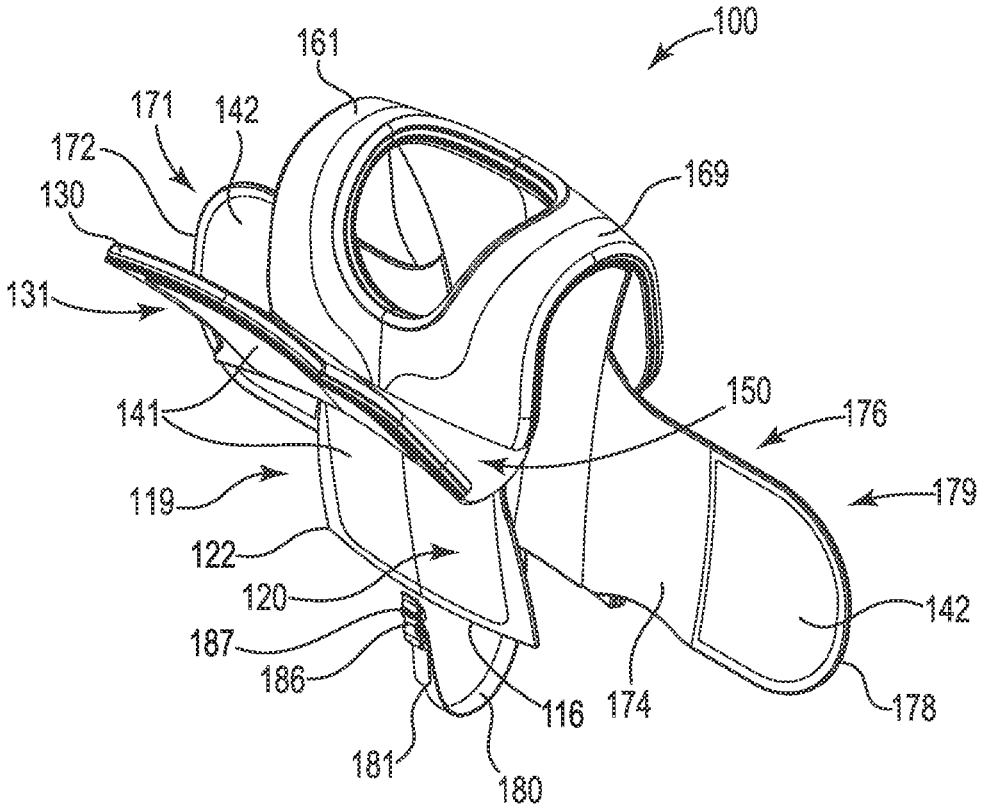
FIG. 8 illustrate a perspective view the neoprene fabric construction of the buoyancy-adjustable swim training vest.
Figure 9A:
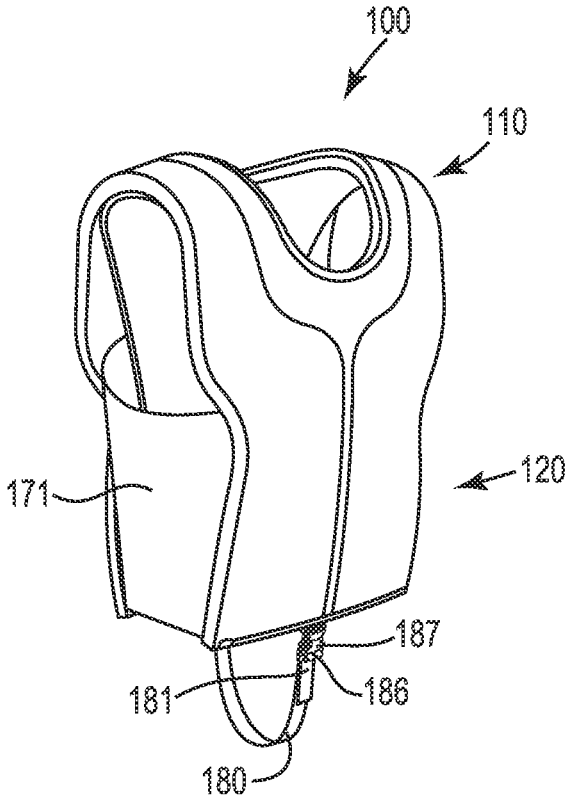
FIGS. 9A-9B illustrate front and rear perspective views of the fabric construction of the buoyancy-adjustable swim training vest.
Figure 9B:
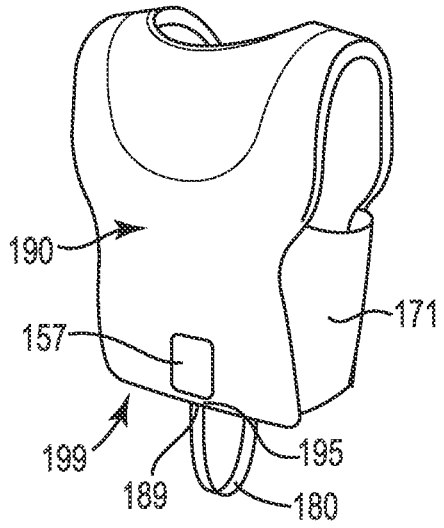

In this embodiment and referring more specifically to FIGS. 8-9B, an at least one polymer strap member 180 is coupled at a distal portion of the at least one strap member 189 to the lower back portion of the sleeveless garment member 199 at a horizontally centered position of the sleeveless garment member 195, the at least one strap member 180 designed to detachably and adjustably couple by a latch portion 186 coupled to a proximal end of the at least one strap member 181 to an at least one buckle member 187, the at least one buckle member 187 coupled to a lower edge portion of the front portion of the sleeveless garment member 116, the at least one strap member 180, when in a coupled state, designed to circumscribe the user's crotch.

In this embodiment of the buoyancy-adjustable swim training vest 100 and referring briefly to FIG. 1, at least one front pocket member 156 is disposed on an outer surface of the front portion of the sleeveless garment member 112 designed to hold at least one removable front buoyant pad member 70.

In this embodiment of the buoyancy-adjustable swim training vest 100 and referring briefly to FIG. 9B, a strap pocket member 157 is disposed substantially on the lower back portion of the sleeveless garment member 199 designed to store the at least one strap member 180 therein.

In this embodiment of the buoyancy-adjustable swim training vest for a user, there are three each removable back buoyant pad members 60 designed to be disposed within the at least one back pocket member 155.

Figure 10C:
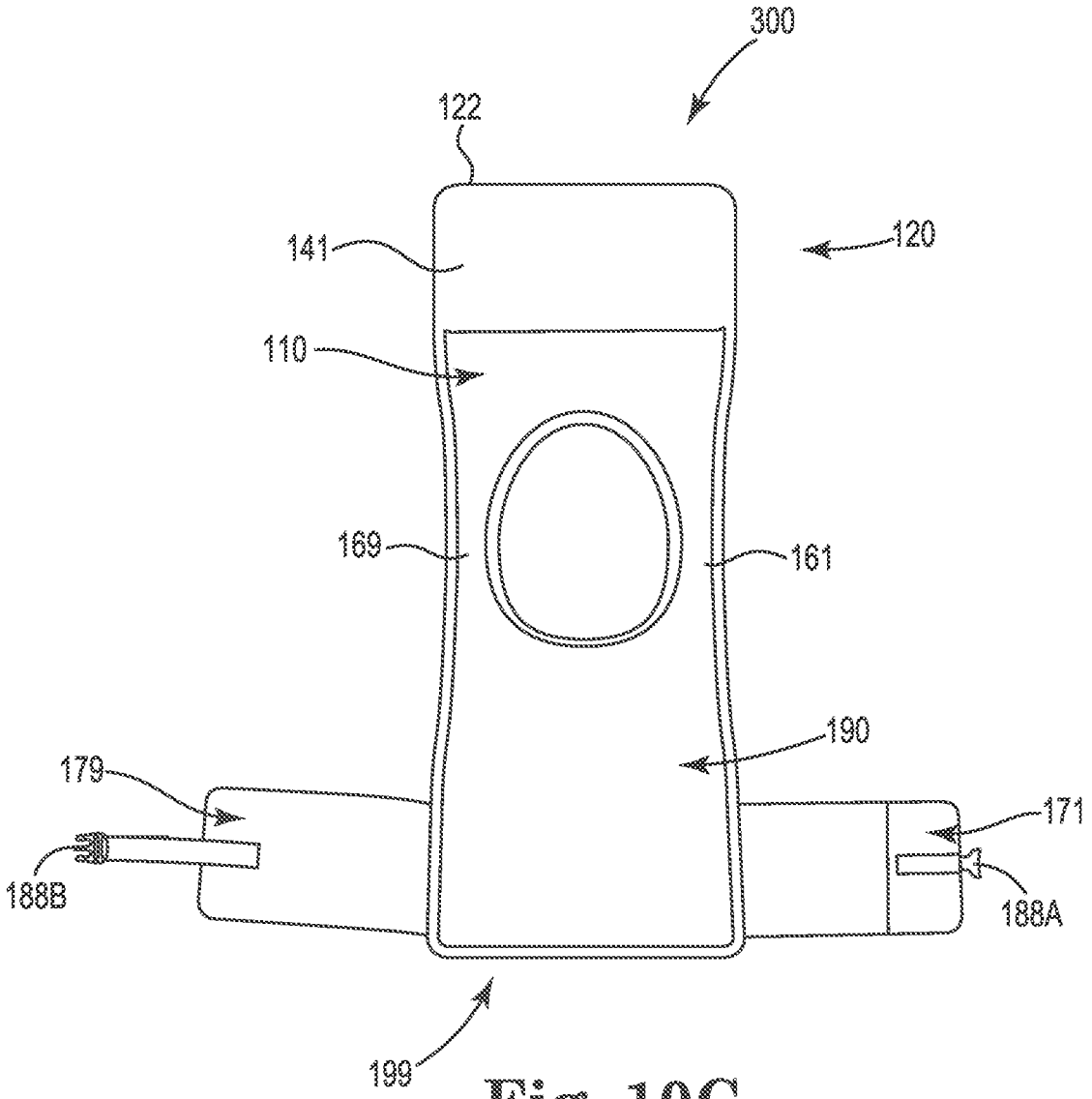

FIGS. 10A-10C illustrate perspective, internal and external views of another embodiment of the buoyancy-adjustable swim training vest 300. In this exemplary embodiment of the sleeveless (optional but preferred) garment or vest member 300 made from substantially 200 gsm Spandex (manufactured fiber in which fiber forming substance is a long chain synthetic polymer comprised of at least 85% of a segmented polyurethane) and ⅛" Neoprene. The right and left wing members 171, 179 are substantially 200 gsm Spandex, the wings members also described as a cummerbund, and allow the swim training vest to hug the user's body. The vest is secured with the first and second hook and loop assemblies 141, 142 (not shown) and a side-release buckle member 188A and clip member 188B. The front pocket member 156 and the back pocket member 155 are subdivided into three internal pockets—back left 155A, back center 155B, back right 155C, front left 156A, front center 156B, front right 156C each to reduce the bulk of the at least one buoyant pad members 60, 70. Pocket hook and loop members 143 hold internal pockets 155A, 155B, 155C, 156A, 156B, 156C closed. Other measurements may be used.

Figure 11A:
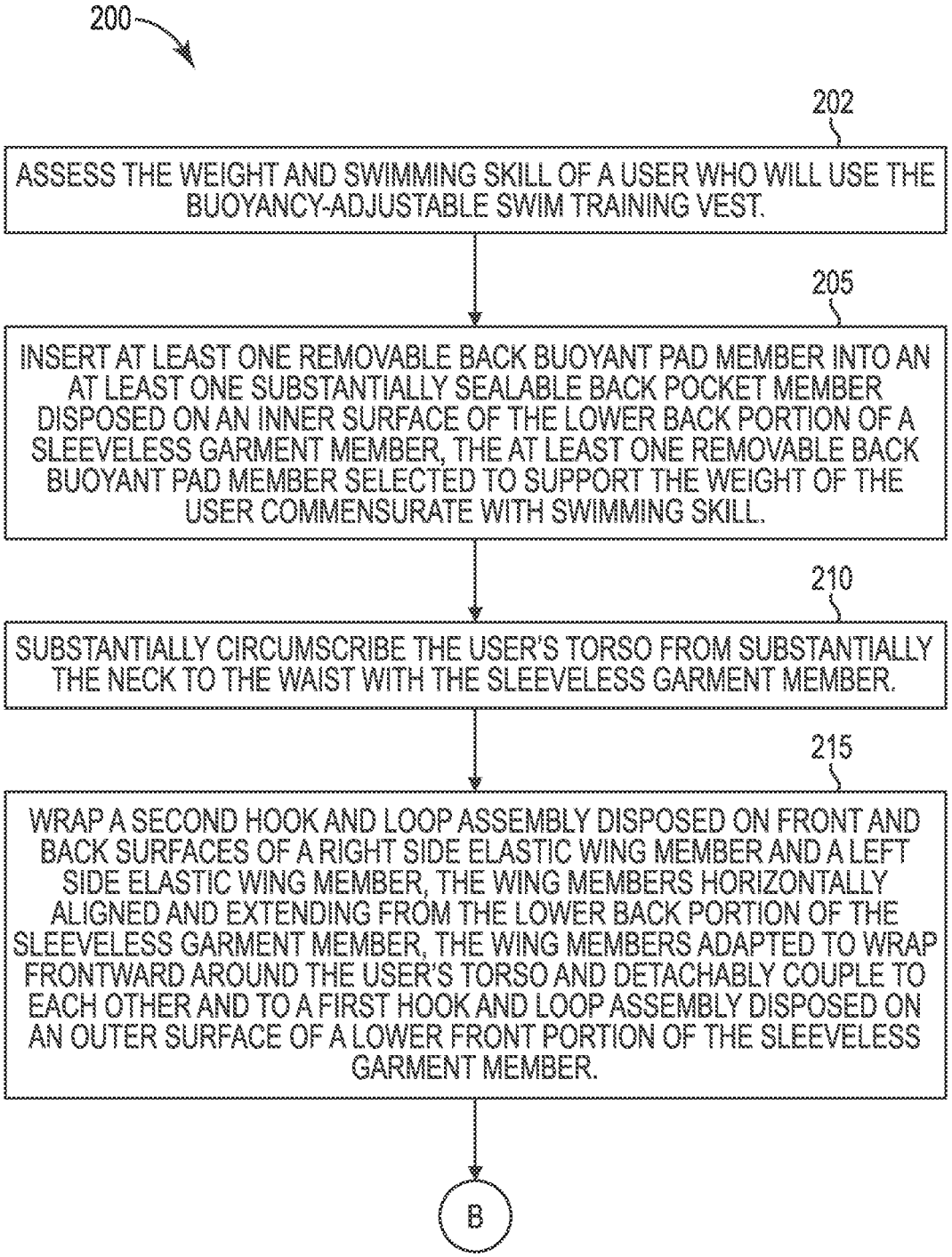
FIGS. 11A-11C illustrates a method for using the buoyancy-adjustable swim training vest.
Figure 11B:
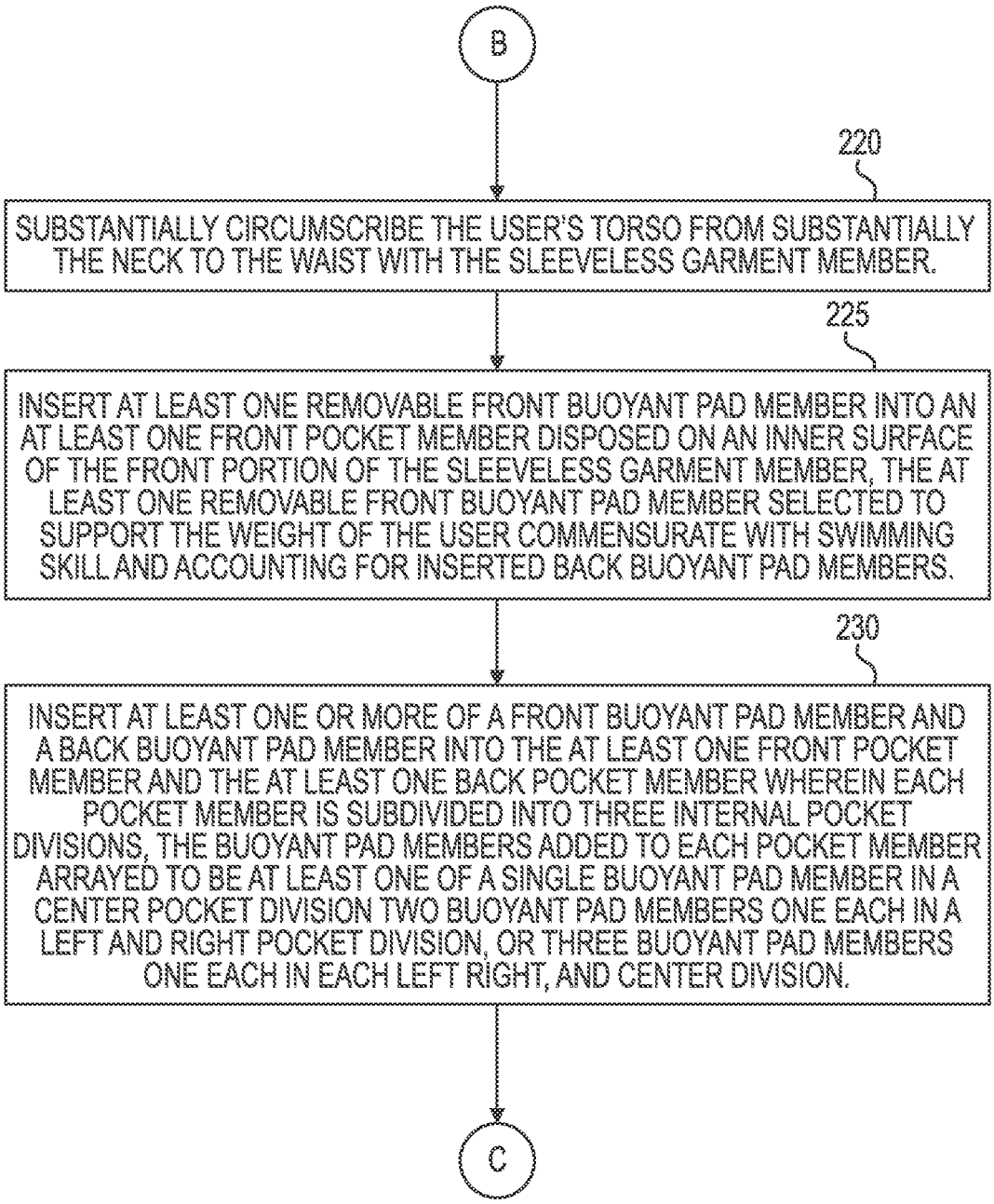
Figure 11C:
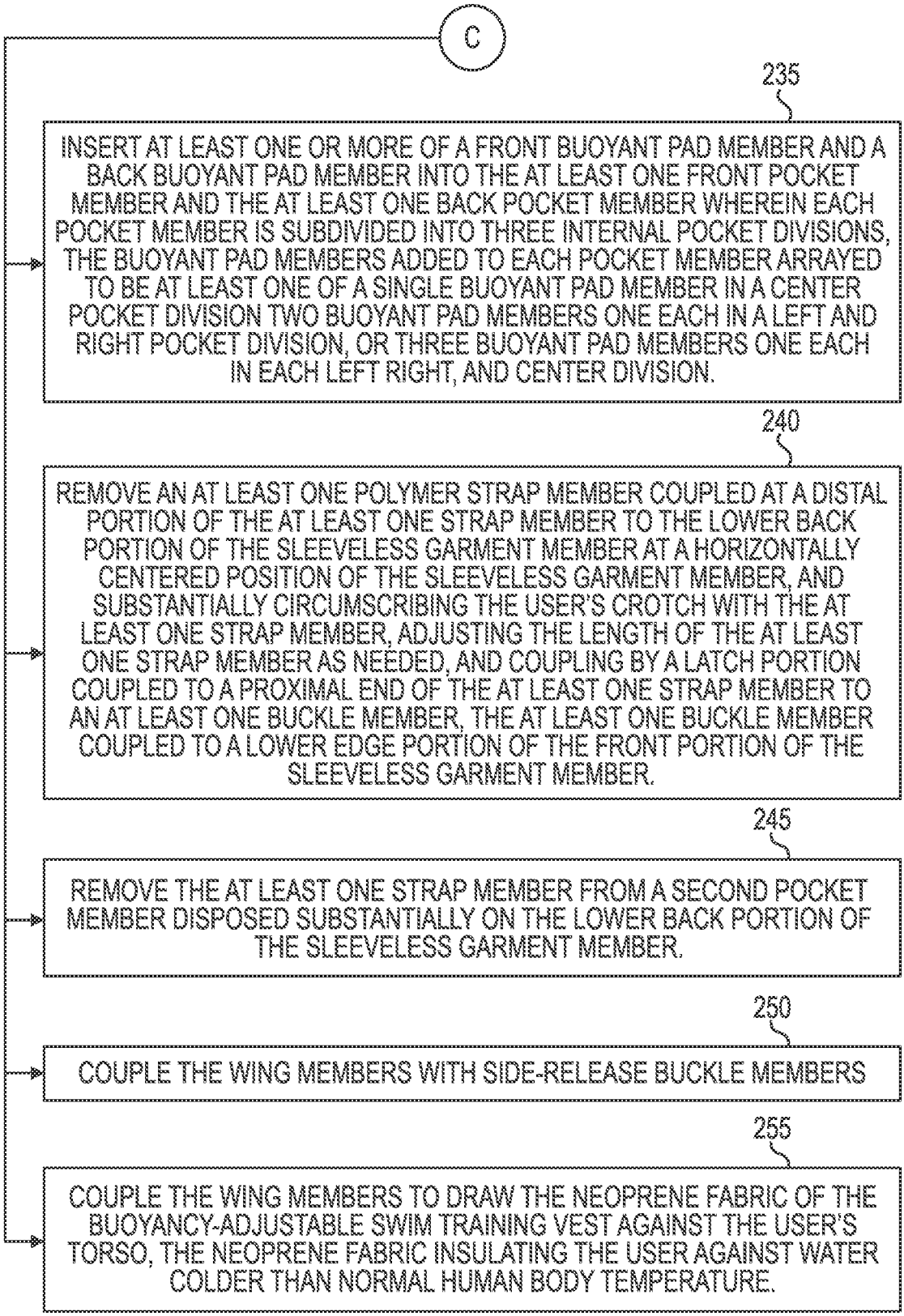

FIG. 11A-11C illustrates a method 200 for using the buoyancy-adjustable swim training vest includes the step 202, assessing the weight and swimming skill of the user who will use the buoyancy-adjustable swim training vest. The method further includes the step 205 inserting at least one removable back buoyant pad member 60 into the at least one substantially sealable back pocket member 155 disposed on the inner surface of the lower back portion of the sleeveless garment member 198, the at least one removable back buoyant pad member 60 selected to support the weight of the user commensurate with swimming skill. The method 200 further includes the step 210 substantially circumscribing the user's torso from substantially the neck to the waist with the sleeveless garment member 100. The method further includes the step 215 wrapping the second hook and loop assembly 142 disposed on front and back surfaces of the right side elastic wing member 171 and the left side elastic wing member 179, the wing members 171, 172 horizontally aligned and extending from the lower back portion of the sleeveless garment member 199, the wing members 171, 172 adapted to wrap frontward around the user's torso and detachably couple to each other and to the first hook and loop assembly 141 disposed on the outer surface of the lower front portion of the sleeveless garment member 122. The method 200 further includes the step 220 assisting the user in one or more swimming engagements wherein as the swimming skills improve, at least one of the at least one buoyant pad members 60, 70 are removed.

FIG. 11A-11C further illustrates the method 200 for using the buoyancy-adjustable swim training vest, the method further including the step 230, inserting at least one removable front buoyant pad member 70 into the at least one front pocket member 156 disposed on the inner surface of the front portion of the sleeveless garment member 110, the at least one removable front buoyant pad member 70 selected to support the weight of the user commensurate with swimming skill and accounting for inserted back buoyant pad members 60.

FIG. 11A-11C further illustrates that the method 200 for using the buoyancy-adjustable swim training vest may include the step 235, inserting at least one or more of the front buoyant pad member 70 and the back buoyant pad member 60 into the at least one front pocket member 156 and the at least one back pocket member 155 wherein each pocket member 155, 156 is subdivided into three internal pocket divisions 155A, 155B, 155C, 156A, 156B, 156C, the buoyant pad members 60, 70 added to each pocket member 155, 156 arrayed to be at least one of the single buoyant pad member 60, 70 in the center pocket division 155B, 156B two buoyant pad members one each in the left and right pocket division 155A, 155C, 156A, 156C, or three buoyant pad members one each in each left right, and center division 155A, 155B, 155C, 156A, 156B, 156C.

FIG. 11A-11C further illustrates that the method 200 for using the buoyancy-adjustable swim training vest may include the step 240, including removing the at least one polymer strap member 180 coupled at the distal portion of the at least one strap member 189 to the lower back portion of the sleeveless garment member 199 at the horizontally centered position of the sleeveless garment member 195, and substantially circumscribing the user's crotch with the at least one strap member 180, adjusting the length of the at least one strap member 180 as needed, and coupling by the latch portion coupled 186 to the proximal end of the at least one strap member 181 to the at least one buckle member 187, the at least one buckle member 187 coupled to the lower edge portion of the front portion of the sleeveless garment member 116.

FIG. 11A-11C further illustrates that the method 200 for using the buoyancy-adjustable swim training vest may include the step 245, including removing the at least one strap member 180 from the second pocket member disposed substantially on the lower back portion of the sleeveless garment member 199.

FIG. 11A-11C further illustrates that the method 200 for using the buoyancy-adjustable swim training vest may include the step 250, including coupling the wing members 171, 172 with side-release buckle members.

FIG. 11A-11C further illustrates that the method 200 for using the buoyancy-adjustable swim training vest may include the step 255, including coupling the wing members 171, 172 to draw the neoprene fabric 150 of the buoyancy-adjustable swim training vest against the user's torso, the neoprene fabric 150 insulating the user against water colder than normal human body temperature.

The following patents are incorporated by reference in their entireties: U.S. Pat. Nos. 6,659,689, 7,438,619, and 20120149261A1.

While the inventive concept has been described above in terms of specific embodiments, it is to be understood that the inventive concept is not limited to these disclosed embodiments. Upon reading the teachings of this disclosure, many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A buoyancy-adjustable swim training vest for a user comprising;

a sleeveless garment member adapted to substantially circumscribe the user's torso from substantially the neck to the waist, the sleeveless garment member further comprising substantially a neoprene fabric;

a front portion of the sleeveless garment member having, at a lower front portion of the sleeveless garment member, a first hook and loop assembly disposed on the outer surface of the lower front portion of the sleeveless garment member;

a back portion of the sleeveless garment member, coupled to the front portion of the sleeveless garment member by a right shoulder portion and a left shoulder portion, the back portion of the sleeveless garment member having a right side elastic wing member and a left side elastic wing member, the wing members horizontally aligned and extending from a lower back portion of the sleeveless garment member, a second hook and loop assembly disposed on front and back surfaces of the wing members, the wing members adapted to wrap frontward around the user's torso and detachably couple by respective hook and loop assemblies to each other and to the outer surface of the lower front portion of the sleeveless garment member;

at least one substantially sealable back pocket member disposed on an outer surface of the lower back portion of the sleeveless garment member adapted to hold at least one removable back buoyant pad member; and at least one substantially sealable front pocket member disposed on an outer surface of the front portion of the sleeveless garment member adapted to hold at least one removable front buoyant pad member; and wherein the at least one front pocket member and the at least one back pocket member are each subdivided into three internal pocket divisions, each adapted to hold at least one buoyant pad member, the buoyant pad members added to each pocket member arrayed to be at least one of a single buoyant pad member in a center pocket division, two buoyant pad members one each in a left and right pocket division, or three buoyant pad members one each in each left right, and center division.

2. The buoyancy-adjustable swim training vest for a user of claim 1, wherein the wing members are further coupled by at least one side-release buckle member.

3. A buoyancy-adjustable swim training vest for a user comprising:

a garment member adapted to substantially circumscribe the user's torso from substantially the neck to the waist, the garment member configured substantially from a flexible fabric;

a front portion of the garment member having, at a lower front portion of the garment member, a front cover member removably coupled to an outer surface of the lower front portion of the garment member by a first hook and loop assembly disposed on an interior face of the front cover member and disposed on the outer surface of the lower front portion of the garment member, the front cover member pivotally and horizontally coupled to a middle front portion of the garment member so as to be vertically liftable to expose the outer face of the lower front portion of the garment member thereunder;

a back portion of the garment member, coupled to the front portion of the garment member by a right shoulder portion and a left shoulder portion, the back portion of the garment member having a right side elastic wing member and a left side elastic wing member, the wing members horizontally aligned and extending from a lower back portion of the garment member, a second hook and loop assembly disposed on front and back surfaces of the wing members, the wing members adapted to wrap frontward around the user's torso and detachably couple by respective hook and loop assemblies to each other, to the outer surface of the lower front portion of the garment member, and to the interior face of the front cover member of the lower front portion of the garment member, the outer ends of the wing members overlapping each other and disposed between the interior surface of the front cover member and the outer face of the lower front portion of the garment member;

at least one substantially sealable back pocket member disposed on an outer surface of the lower back portion of the garment member adapted to hold at least one removable back buoyant pad member; and at least one substantially sealable front pocket member disposed on an outer surface of the front portion of the garment member adapted to hold at least one removable front buoyant pad member, and wherein at least one polymer strap member is coupled at a distal portion of the at least one strap member to the lower back portion of the garment member at a horizontally centered position of the garment member, the at least one strap member adapted to detachably and adjustably coupled by a latch portion, the latch portion coupled to a proximal end of the at least one strap member and coupled to an at least one buckle member, the at least one buckle member coupled to a lower edge portion of the front portion of the garment member, the at least one strap member, when in a coupled state, adapted to circumscribe the user's crotch.

4. The buoyancy-adjustable swim training vest for a user of claim 3, wherein the wing members are further coupled by a side-release buckle member.

5. The buoyancy-adjustable swim training vest for a user of claim 3, wherein at least one hook and loop assembly is supplemented for attachment by at least one or more of a buckle, clip, strap, button, tie, buckle and belt, and flexible strip of metal or plastic with interlocking projections closed or opened by pulling a slide along them.

6. A method for using a buoyancy-adjustable swim training vest, the method comprising:

assessing the weight and swimming skill of a user who will use the buoyancy-adjustable swim training vest;

inserting at least one removable back buoyant pad member into at least one substantially sealable back pocket member disposed on an inner surface of the lower back portion of a garment member, the at least one removable back buoyant pad member selected to support the weight of the user commensurate with swimming skill; circumscribing the user's torso from substantially the neck to the waist with the garment member;

wrapping a second hook and loop assembly disposed on front and back surfaces of a right side elastic wing member and a left side elastic wing member, the wing members horizontally aligned and extending from the lower back portion of the garment member, the wing members adapted to wrap frontward around the user's torso and detachably couple to each other and to a first hook and loop assembly disposed on an outer surface of a lower front portion of the garment member; and assisting the user in one or more swimming engagements wherein as the swimming skills improve, at least one of the at least one buoyant pad members are removed; and further including inserting at least one or more of a front buoyant pad member and a back buoyant pad member into at least one front pocket member and the at least one back pocket member wherein each pocket member is subdivided into three internal pocket divisions, the buoyant pad members added to each pocket member arrayed to be at least one of a single buoyant pad member in a center pocket division, two buoyant pad members one each in a left and right pocket division, or three buoyant pad members one each in each left right, and center division.

7. The method for using a buoyancy-adjustable swim training vest of claim, 6 further including removing at least one polymer strap member coupled at a distal portion of the at least one strap member to the lower back portion of the sleeveless garment member at a horizontally centered position of the garment member, and substantially circumscribing the user's crotch with the at least one strap member, adjusting the length of the at least one strap member as needed, and coupling by a latch portion to an at least one buckle member coupled to a lower edge portion of the front portion of the sleeveless garment member.

8. The method for using a buoyancy-adjustable swim training vest of claim, 6 the method further including removing the at least one strap member from a second pocket member disposed substantially on the lower back portion of the garment member.

9. The method for using a buoyancy-adjustable swim training vest of claim, 6 the method further including coupling the wing members with side-release buckle members.

* * * * *